US007128320B2

(12) United States Patent
Yamaguchi et al.

(10) Patent No.: US 7,128,320 B2
(45) Date of Patent: Oct. 31, 2006

(54) BINGO GAME SHEET

(75) Inventors: Katsuichiro Yamaguchi, Tokyo (JP); Kazuki Saito, Funabashi (JP)

(73) Assignee: Direct Network, Inc., Tokyo (JP)

( * ) Notice: Subject to any disclaimer, the term of this patent is extended or adjusted under 35 U.S.C. 154(b) by 74 days.

(21) Appl. No.: 10/712,386

(22) Filed: Nov. 12, 2003

(65) Prior Publication Data

US 2005/0098950 A1 May 12, 2005

(51) Int. Cl.
*A63F 3/06* (2006.01)

(52) U.S. Cl. ..... 273/269; 273/244.1; 273/244.2; 273/139; 273/138.1

(58) Field of Classification Search ..... 273/269, 273/244.1, 244.2, 139, 138.1; 463/17, 18, 463/19

See application file for complete search history.

(56) References Cited

U.S. PATENT DOCUMENTS

| | | | | |
|---|---|---|---|---|
| 4,883,636 | A | 11/1989 | Fantle, Jr. | |
| 5,782,470 | A * | 7/1998 | Langan | 273/139 |
| 2003/0224847 | A1 * | 12/2003 | Jaimet | 463/16 |

* cited by examiner

*Primary Examiner*—Benjamin Layno
(74) *Attorney, Agent, or Firm*—Welsh & Katz, Ltd.

(57) ABSTRACT

A bingo game sheet for playing a game in combination with a baseball game or the like, includes five rows and five columns which intersect to form a five by five matrix having twenty five zones, each of the rows and columns being associated with a particular inning number or one special event designation so that one zone becomes associated with the two inning numbers or with the one inning number and the special event designation, each zone containing indicia which corresponds to a play or event associated with a baseball game. The particular game and an arrangement of the twenty-five zones on the sheet are identified through the control number to find out the winners.

4 Claims, 2 Drawing Sheets

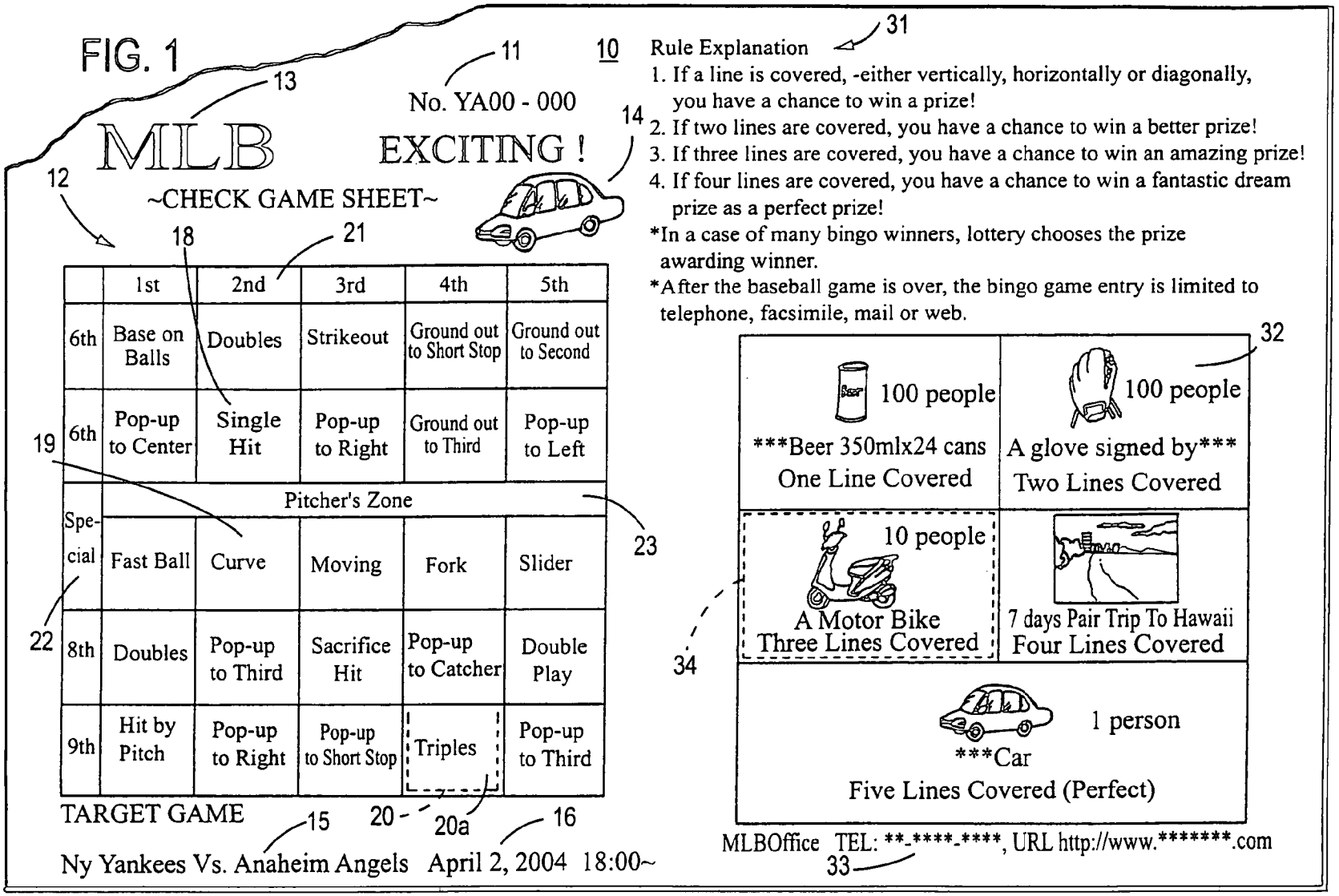
FIG. 1
10
11
No. YA00 - 000
13
MLB
EXCITING !
~CHECK GAME SHEET~
14
12
21
18
19
22
20
20a
15
16
23
Rule Explanation
31
1. If a line is covered, -either vertically, horizontally or diagonally, you have a chance to win a prize!
2. If two lines are covered, you have a chance to win a better prize!
3. If three lines are covered, you have a chance to win an amazing prize!
4. If four lines are covered, you have a chance to win a fantastic dream prize as a perfect prize!
*In a case of many bingo winners, lottery chooses the prize awarding winner.
*After the baseball game is over, the bingo game entry is limited to telephone, facsimile, mail or web.
32
100 people
***Beer 350mlx24 cans
One Line Covered
100 people
A glove signed by***
Two Lines Covered
10 people
A Motor Bike
Three Lines Covered
34
7 days Pair Trip To Hawaii
Four Lines Covered
1 person
***Car
Five Lines Covered (Perfect)
MLBOffice TEL: --, URL http://www.****.com
33
1st
2nd
3rd
4th
5th
6th
Base on Balls
Doubles
Strikeout
Ground out to Short Stop
Ground out to Second
6th
Pop-up to Center
Single Hit
Pop-up to Right
Ground out to Third
Pop-up to Left
Pitcher's Zone
Spe-cial
Fast Ball
Curve
Moving
Fork
Slider
8th
Doubles
Pop-up to Third
Sacrifice Hit
Pop-up to Catcher
Double Play
9th
Hit by Pitch
Pop-up to Right
Pop-up to Short Stop
Triples
Pop-up to Third
TARGET GAME
Ny Yankees Vs. Anaheim Angels April 2, 2004 18:00~

BINGO GAME SHEET

FIELD OF THE INVENTION

This invention relates to a bingo game sheet in association with an on-going athletic event such as a baseball game and, more particularly, to a bingo game sheet to be played with many game spectators and televiewers.

BACKGROUND OF THE INVENTION

Description of Related Art

The game of baseball has now become beyond question the leading feature of the outdoor sports of the United States and even other foreign countries. Enthusiastic fans of a particular team may go to ballparks to enjoy the game, while fans may stay home or go to sports cafés or bars to watch the game broadcasted via cable television, satellite, or network such as the Internet. Some may love to see his favorite player hit a home run and feel great when seeing his favorite pitcher take a strikeout from a slugger of the opponent team.

From the aspect of the baseball business, very successful scenarios are to keep attracting many fans continuously. One game of the baseball generally takes time around two or three hours, and if the spectators and televiewers of the game keep attention to the entire game period, the commercial value of the game is much more raised. When the game is tight, the spectators and televiewers likely keep interests on the game, but when the game is of a blow-out for one team, people, particularly fans for the team unlikely coming back, may not keep watching the game until the end of the game. In some cases, a person watches the game simply because his closely associated person is watching the game, and motivation to keep watching the game in such a case may tend to decrease as the game innings proceeds further due to viewer's boring.

In a meantime, the game of bingo is frequently used in such as parties and other situation for entertaining guests and participants. To play the game of bingo, each player is provided with a card or sheet typically including a matrix of five rows and five columns defining twenty-five grid squares. Each grid square contains a single game symbol typically representing a number in the range of 1 to 75. No number in the different grid squares is the same, and the middle grid square in the third row and the third column typically contains no number traditionally referred to as the "free square." As the game proceeds, numbers are drawn, and each player places marks on the drawn numbers by punching out portions of the numbers along the perforation around the corresponding numbers. When at least one straight line of the gird squares is covered by the marked numbers, a winner may be declared to award the prize. In a certain gaming way, two or more lines may give a greater prize to the winner.

As modified bingo games, games have been known to played in conjunction with on-going competitive athletic event. In U.S. Pat. No. 4,883,636 a baseball bingo-type game is disclosed which uses a conventional pre-printed bingo playing card having nine rows which represent nine innings of a baseball game for a visiting team and nine columns which represent the same nine innings for a home team. Each resulting square in the nine-by-nine matrix is pre-printed with a baseball play. When a play on a given space is made by a player on either the home or visiting team, it is covered with a chip or marker by the contestant. As with all conventional bingo games, a winning contestant is determined when a predetermined pattern of zones or spaces is covered by markers (e.g., all the zones in a row, column, or diagonal). This game is not satisfactory for various reasons. For example, if a winner is decided by coverage of all nine zones in a row, column, or diagonal, and if such coverage ends midway, the player likely loses interests in continuing the bingo game after the coverage ends. To place markings on the card properly, the player has to pay attention to the inning number as well as the top or bottom, and if the player places the marking in a wrong zone by mistakenly identifying whether the current event is in the top or the bottom, the entire game of bingo becomes useless, and this may provide negative effects on enjoyments on the baseball game.

SUMMARY OF THE INVENTION

It is an object of the invention to provide a bingo game sheet easily maintaining play's interests throughout the game period.

It is another object of the invention to provide a bingo game system allowing a large number of people to play and receive award even where such game players are remote and could not properly place marking on the bingo game sheet.

The foregoing objects are accomplished to provide a bingo game sheet for playing a game in combination with a baseball game, including five rows and five columns which intersect to form a five by five matrix having twenty five zones, each of the rows and columns being associated with a particular inning number or one special event designation so that one zone becomes associated with the two inning numbers or with the one inning number and the special event designation, each zone containing indicia which corresponds to a play or event associated with a baseball game, and an identifying means for identifying a particular baseball game and an arrangement of the twenty-five zones.

In another aspect of the invention, a baseball based bingo game system to be played with an on-going baseball game, the bingo game system including a plurality of bingo game sheets, each bingo game sheet having five rows and five columns which intersect to form a five by five matrix having twenty five zones, each of the rows and columns being associated with a particular inning number or one special event designation so that one zone becomes associated with the two inning numbers or with the one inning number and the special event designation, each zone containing indicia which corresponds to a play or event associated with a baseball game, and an identifying means for identifying a particular baseball game and an arrangement of the twenty five zones; a memorizing means for memorizing the arrangement of the twenty-five zones of each bingo game sheet with the corresponding identifying means; and a controlling means for monitoring events happened in the on-going baseball game and finding out how many lines are covered in each bingo game sheet.

In yet another aspect of the invention, a bingo game sheet for playing a game in combination with a sport event, the bingo game sheet including five rows and five columns which intersect to form a five by five matrix having twenty five zones, each of the rows and columns being associated with a particular stage or one special event designation so that one zone becomes associated with the two stages or with the one inning number and the special event designation, each zone containing indicia which corresponds to a play or event associated with the sport event, and an identifying means for identifying a particular baseball game and an arrangement of the twenty-five zones.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which:

FIG. 1 is a plan view showing a bingo game sheet according to a preferred embodiment of the invention.

DETAILED DESCRIPTION OF THE INVENTION

Figure 2:
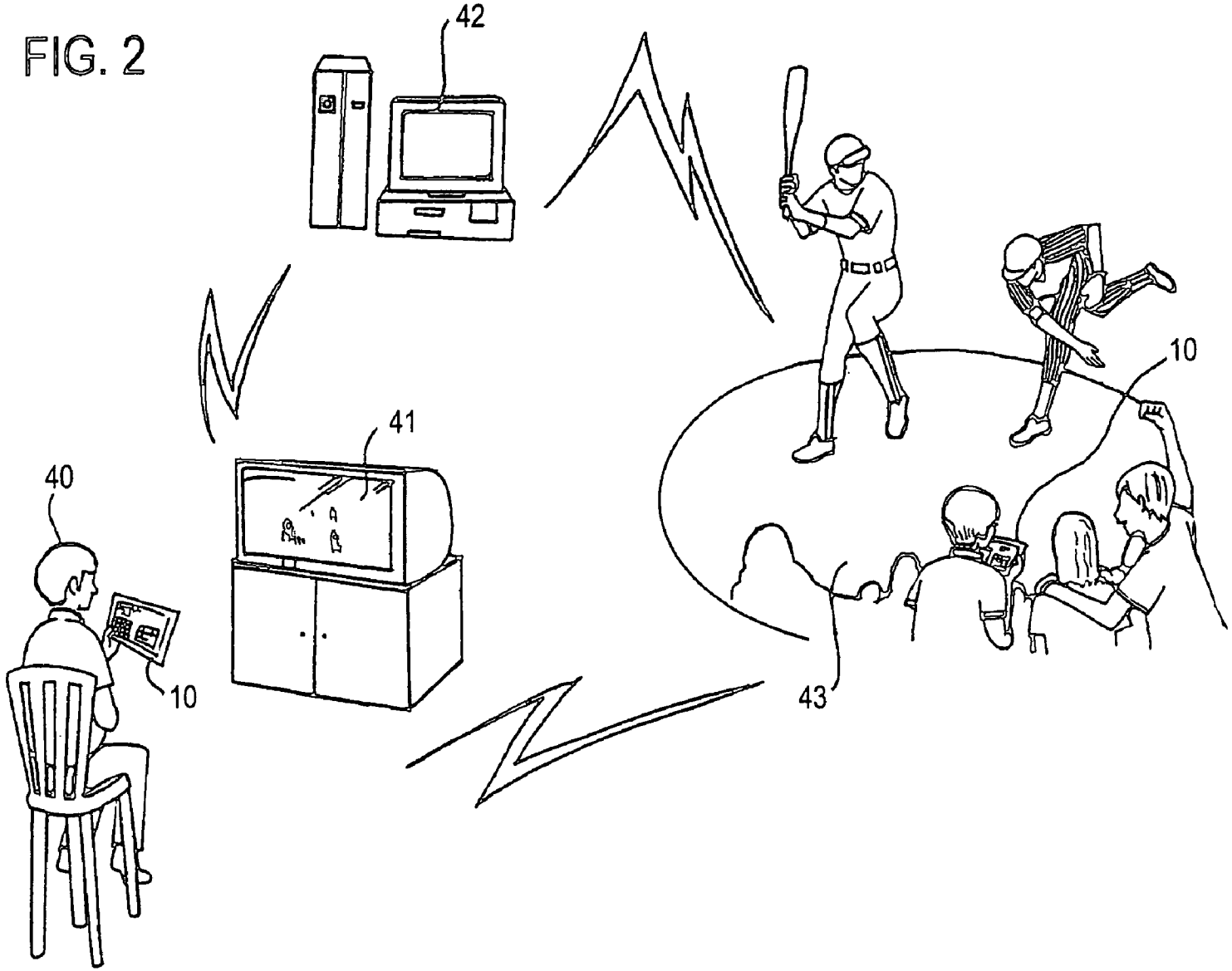
FIG. 2 is an illustration showing a baseball based bingo game system according to a preferred embodiment of the invention.

As required, detailed embodiments of the present invention are described herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

FIG. 1 is a plan view showing a bingo game sheet according to a preferred embodiment of the invention. The bingo game sheet 10 is made of a printed material such as printed-paper or synthetic resin sheet. The bingo game sheet 10 has five rows and five columns which intersect to form a five by five matrix 12 having twenty five zones. An inning indication 21 is placed at an upper end of the five by five matrix 12, and another inning indication 22 is placed at a left end of the five by five matrix 12. In the inning indication 21, the first column corresponds to the first inning; the second column corresponds to the second inning; the third column corresponds to the third inning; the fourth column corresponds to the fourth inning; the fifth column corresponds to the fifth inning. In the inning indication 22, the first row corresponds to the sixth inning; the second row corresponds to the seventh inning; the third row corresponds to a pitcher's zone 23, which does not correspond to any inning but is to be covered upon occurrence of the printed pitching ball type; the fourth row corresponds to the eighth inning; the fifth row corresponds to the ninth inning. Those inning indications 21, 22 can be modified and, for example, the innings of the first to fifth can be placed for designation of the rows while the innings of the sixth to ninth can be placed for designation of the columns. Each zone may include a perforation to be cut out when the event described in the zone occurs or the equivalent to clearly identify the covered zones, and in FIG. 1 a perforation 20 is formed at only one zone 20*a* for illustrative purpose, but such a perforation can be provided in all zones.

The five rows and the five columns are intersected to form the twenty-five zones, and each zone has a play related indicia. For example, the second row and the second column zone 18 has an indicia of "Single Hit"; the third row and the third column zone 19 has an indicia of "Curve" as one special designation, or namely, one pitcher's play. Such an indicia in each zone can be selected from, e.g., fourteen kinds of at-bat plays, six kinds of base related plays, six kinds of ground outs, nine kinds of fly or liner outs, seven kinds of other outs, and some special event designation. For example, the fourteen kinds of at-bat plays are: bunt hit, infield hit, ground hit between the first base and the second base, ground hit between the second base and the third base, single hit to the right, single hit to the center, single hit to the left, double, triple, running home run, home run, walk, hit by a pitch, and interference to batting. The six kinds of base related plays are: stealing the second base, stealing the third base, stealing home, balk, tagging up, and run by tagging up. The six kinds of ground outs are: ground to the first baseman, ground to the second baseman, ground to the third baseman, ground to the short stop, comebacker, and ground to the catcher. The nine kinds of fly or liner outs are: fly out or liner to the first baseman, fly out or liner to the second baseman, fly out or liner to the third baseman, fly out or liner to the short stop, fly out or liner to the pitcher, fly out or liner to the catcher, fly out or liner to the left fielder, fly out or liner to the center fielder, and fly out or liner to the right fielder. The seven kinds of other outs are: strikeout, putting out on strikeout, sacrifice out; double plays; triple plays; caught stealing; and tagging up and out. However, those kinds of plays are merely examples, and the game organizer or designer of this bingo game may choose other selections according to such as number of awards, or particular favorite plays. For example, if the best prize is a very expensive item such as an automobile or the like in a case where, e.g., five lines or more are covered, one indicia may be selected from a play hardly happened in any game to substantially reduce the number of the game winners. Some zone can be free zone to render many game player the winners of the game.

The pitcher's zone 23, as a feature of a special event designation, is unique among bingo games. The pitcher's zone 23 is made of five square zones, each zone includes an indicia of one ball type, such as fast ball, curve, moving, fork, slider, knuckle, screw, sinker, and the like. This special event designation is placed at the third row or at the third column to occupy the center area in the row or column direction and thereby to increase the possibility for line coverage. When the pitcher of the on-going game pitches the ball as one of the above types, the bingo game player watches what ball the pitcher throws. This designation promotes excitements on the bingo game players' side because the balls are pitched at every batting, and also, to find out what ball type is pitched, the bingo game players have to pay close attentions on pitcher's balls, so that playing with this bingo game can keep the game spectators and televiewers' eyes on the on-going baseball game.

Although in this embodiment the special event designation is selected from pitcher's ball types, other selections can be used. As such other selections, exemplified are pitching courses, such as high and tight, low and away, and the like, and such pitching courses can be combined with a ball or strike distinction as well as ball number or batting results. In this embodiment, the pitcher's zone 23, as a feature of a special event designation, is placed in the third row, but such a special event designation can be placed in any row or column to modify the simulation of the bingo game players. Although in this embodiment only one of the special event designation is placed, plural designation areas or not straight line pattern of the special event designation area can be placed in one bingo game sheet.

This bingo game sheet 10 further includes, on an upper area of the five by five matrix 12, a title section 13, a control number section 11, and an advertising section 14. The title section 13 is for showing the name of the game sheet and may function as an advertising section. When the bingo game is sponsored by a company "A", the title section 13 can include the name of "A" as one feature of the advertisement. The control number section 11 includes indicia, that is, a number for controlling the winners. This number is provided corresponding to the arrangement of the plays in the five by five matrix 12. Though some sheets can have the same arrangement, the arrangement may vary sheet by sheet, and each arrangement of the plays is memorized in a computer system, as described below, to effectively determine which bingo game sheets are of the winners. The digits of the control number can be several or more depending on how many sheets are distributed. The control number may includes alphabets, and symbols. The advertising section 14 is provided for commercial purposes. Where this bingo game sheet 10 serves as a material for promotion, the advertising section 14 may includes images, illustrations, names, marks, slogans, and combinations thereof for goods or services to be promoted.

The bingo game sheet 10 also includes, on a lower area of the five by five matrix 12, a game indication 15, and a date section 16. The game indication 15 shows the particular baseball game corresponding to the bingo game sheet 10. The date section 16 is for day and time at which the particular baseball game begins. The game indication 15 or the date section 16 also may include a broadcasting program channel and time, and the ballpark at which the particular baseball game is held.

On the right side of the sheet, there is a section of the rule explanation 31. As the general rule of this bingo game, if one line is covered, the person who has the sheet with the covered line is qualified as a winner. In this bingo game, the person is able to continue playing even after one line is covered for seeking extra lines covered. The rule explanation 31 describes such a process for determining prize winners. In lieu of or in addition of the rule explanation 31, some promotional explanation or advertisement can be placed.

Below the rule explanation 31, a prize introduction section 32 is formed. The prize introduction section 32 is used for introducing the prizes to be provided for winners. The prize introduction section 32 includes pictures of the prizes, awarding amounts, winning qualified number of the lines, and the like. Commercial words or slogan may be added to utilize these bingo game sheets 10 as advertisement, which renders sponsoring companies to join easily and provide items for prizes.

At a bottom of the right side, there is an indication 33 for the managing office of this bingo game system. The indication 33 can be telephone number, facsimile number, mailing address, and web site's URL. Where the player of the bingo game makes confirmation as the winner after the end of the baseball game, the play may ask the management office by phone, facsimile, mail or web. The indication 33 is used for such communications with the above described control number written in the control number section 11.

Since the bingo game sheet 10 is formed of, e.g., a printed paper or resin sheet, the back side of the sheet may be utilized for advertisement of, such as, the sponsor companies. Furthermore, because the bingo game sheet 10 is formed of the printed sheet, the printed sheet with this bingo game may form a portion of the package for the goods, such as a cup for beverage or popcorn, a tray for foods, a paper napkin, etc. In a case that this bingo game sheet is used for a package, the rule explanation 31 and the prize introduction section 32 may be omitted to reduce the area size on the surface of the package. The bingo game sheet 10 may have a coupon portion separable from the sheet itself. An example is that the prize introduction section 32 is used for such a coupon because the section 32 already has pictures and illustration of goods. To render such a coupon detachable from the sheet, perforations made at the same time as the illustrated perforation 20 for the punching around the indicia in each zone in the five by five matrix 12, may be utilized. In FIG. 2, such a perforation 34 is formed for illustrative purpose in a prize.

To play the bingo game, the player at first obtains the preprinted bingo game sheet desirably before the corresponding baseball game begins. The player places markings on the corresponding zones according to occurrence of the plays written at the corresponding zones. At the particular inning of the on-going baseball game, only the corresponding zones related to the inning number are to be covered. That is, at the first inning, the only zones in the first column can be marked or covered, and at the second inning, the second column can be marked. When the pitcher throws the ball, the play pays attention to the type of the ball to properly cover the pitcher's zone 23. Since the pitcher's zone is not relating to any inning, the player has to concern the ball types at least until properly marked. With this bingo game, even where a particular zone is missed during the first to five innings, such a zone may be covered during the six to nine innings, and therefore, the player can keep attentions to the baseball game as well as the bingo game during the whole period of the baseball game.

This bingo game can be played with a very large number of people. Some people may play this bingo game the bingo game sheets at the ballpark at which the corresponding baseball game is held, and some people may play this bingo game with the bingo game sheets at their home by watching the television or the like. Marking on the indicia in each zone may not be done properly for some reasons such as mistakenly placed markings, interruption of watching the game, etc. With this bingo game, the computer assists to complete the bingo game for each sheet. FIG. 2 illustrates the bingo game system according to this invention. Television viewers 40 facing to television sets 41 and spectaculars 43 in the ballpark may play the bingo game with the bingo game sheets 10. Each bingo game sheet 10 may have a unique arrangement of the five by five matrix 12, and each arrangement is memorized in a computer 42 or server connected to the web or other communication means. Updated official information about occurrences as the plays in the particular baseball game is monitored and recorded by the computer 42. Because the computer 42 handles the memorized zone arrangement of each bingo game sheet and the updated official information of the baseball plays, the computer 42 is able to make determinations of which lines are covered in each bingo game sheet easily. When the player asks the result of the bingo game sheet 10, the player uses the control number, and the computer 42 identifies the control number and answers whether the asked bingo game sheet is of the winner or not and if it is of the winner, how many lines are covered or what prize is taken by the holder of the winning bingo game sheet. In a case that too many people become winners, the computer 42 may automatically select the persons who take the prize among many of the winners.

Communications to the computer 42 can be done by telephone in use of an automatic answering system, by facsimile in use of an automatic facsimile answering system, by mail, by email with an automatic answering system, or by web using cgi or other information technologies. By using such an automatic answering system or information technologies, many people can play at one time and can know whether they are qualified for the winners or not as well as whether they can get the prizes. In one modification of this bingo game system, a password for accessing the computer or web page may be of the name of the targeted goods or services. For example, if a company seeks promotions of a new product, a large number of people may memorize the name of the new product where the password for accessing the computer 42 or web page is set for the name of the new product. Furthermore, such a web page may contain the information of the new product. Accessing the web page is not limited to the computer, and cellular phones or PDAs may be used for such accessing.

Although in the above embodiment the sport event is described only as the baseball game, the sport event can be other sports such as basketball games, football games, ice hockey games, soccer games, golf tournaments, tennis games, and other sport events. Each zone can be modified according to the sport event to allow many people play this bingo game.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A method of playing a baseball-based bingo game system to be played with an on-going live baseball game in combination with a bingo game covering one or more lines of bingo game sheets, the bingo game system comprising the steps of:

providing a plurality of bingo game sheets, each bingo game sheet having:

five rows and five columns which intersect to form a five by five matrix having twenty five zones, each zone being associated with a play or event;

the five columns corresponding to the first to fifth innings of a baseball game, respectively;

the first, second, fourth, and fifth rows corresponding to the sixth to ninth innings of the baseball game, respectively;

the third row corresponding to a special zone having five zones, each corresponding to a special play or event regardless of the inning number; and an identifying means for identifying a particular baseball game and an arrangement of the twenty-five zones;

providing memorizing means for memorizing the arrangement of the twenty-five zones of each bingo game sheet with the corresponding identifying means;

providing controlling means for monitoring plays and events occurring in the on-going baseball game and determining how many lines are covered in each bingo game sheet;

watching a live baseball game;

if a play or event occurs during an inning of the live baseball game, then covering the zone in that corresponding column or row if a zone in the corresponding column or row has that corresponding play or event;

playing the special zone during any inning;

if a play or event occurs during any inning, then covering the zone in the special zone that has the corresponding play or event regardless of the inning; and wherein one or more winners of the bingo game are classified by the number of the covered lines on the bingo game sheet, said number of winners determined by a lottery if the number of the bingo game sheets qualified for a prize award is more than an expected number of winners.

2. The method of playing a baseball-based bingo game sheet according to claim 1, wherein the special zone includes pitcher's play, batter's play, member changes, scores, and errors.

3. The method of playing a baseball based bingo game system according to claim 2, wherein the pitcher's plays include types of pitched balls.

4. The method of playing a baseball-based bingo game system according to claim 1, wherein the controlling means is responsive when asked through telephone, facsimile, mail, e-mail, and Internet connection.

* * * * *